United States Patent [19]

Reinhardt

[11] Patent Number: 4,568,064

[45] Date of Patent: Feb. 4, 1986

[54] MECHANICAL LIFTING JACK

[75] Inventor: John T. Reinhardt, Kitchener, Canada

[73] Assignee: J. C. Hallman Manufacturing Company Limited, Waterloo, Canada

[21] Appl. No.: 678,534

[22] Filed: Dec. 5, 1984

[51] Int. Cl.[4] ..... B66F 1/04

[52] U.S. Cl. ..... 254/111; 74/581

[58] Field of Search ..... 254/108–111, 254/1, DIG. 3; 74/412 TA, 581, 584

[56] References Cited

U.S. PATENT DOCUMENTS 1,384,270 7/1921 Murphy ..... 74/584

4,379,546 4/1983 McIntosh ..... 254/111

*Primary Examiner*—Robert C. Watson

*Attorney, Agent, or Firm*—Robert F. Delbridge; Arne I. Fors

[57] ABSTRACT

A mechanical lifting jack has an upper lifting assembly and a lower follower assembly slidably mounted on a vertical support and engageable therewith at predetermined positions over its height. An operating handle is pivotally connected at one end to the lifting assembly for upward and downward angular movement, and a safety link is pivotally connected at an upper end to the handle and at a lower end to the follower assembly. The lifting assembly carries a reversing member operable in one position to cause a load engaged by the lifting assembly to be raised by alternate upward movement of the lifting assembly and follower assembly up the support when the handle is moved upwardly and downwardly, and operable in another position to cause a load to be lowered by alternate downward movement of the lifting assembly and follower assembly with similar movement of the handle. The safety link has a portion yieldable by deformation when the handle is moved downwardly with the reversing member in the up position and the load engaged by the lifting assembly is above a predetermined value to prevent further raising or lowering of the load.

1 Claim, 8 Drawing Figures

Figure 1:
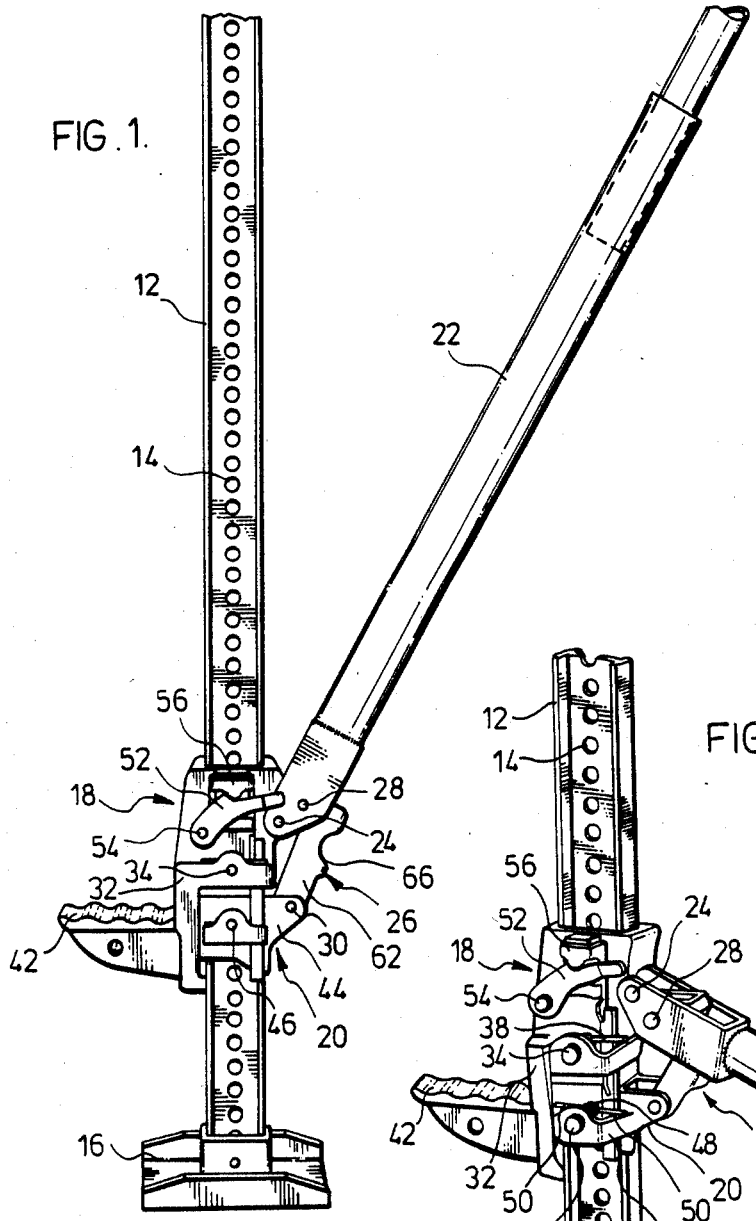

FIG. 3.
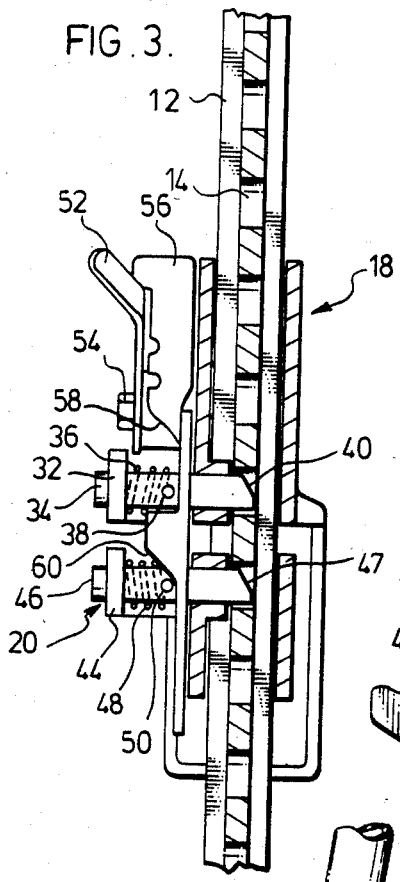
FIG. 5.
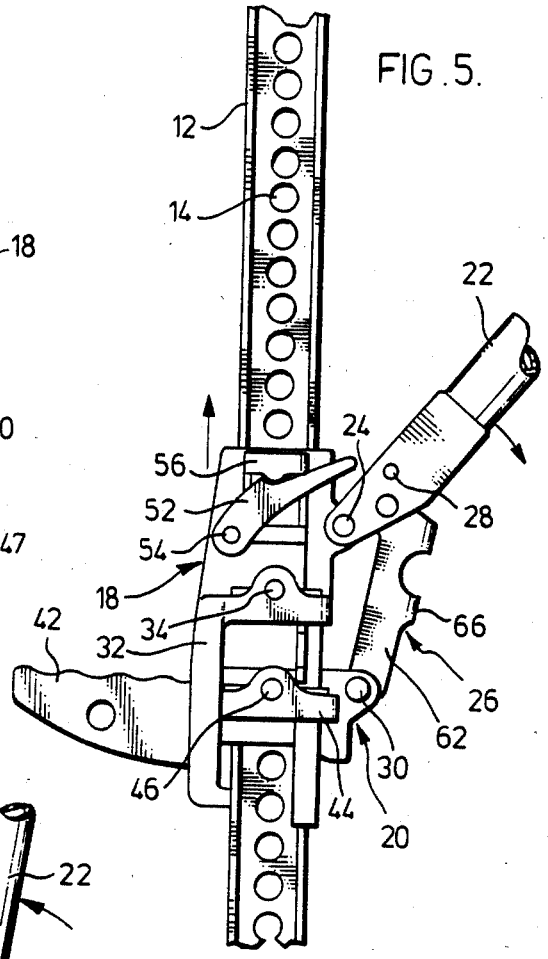
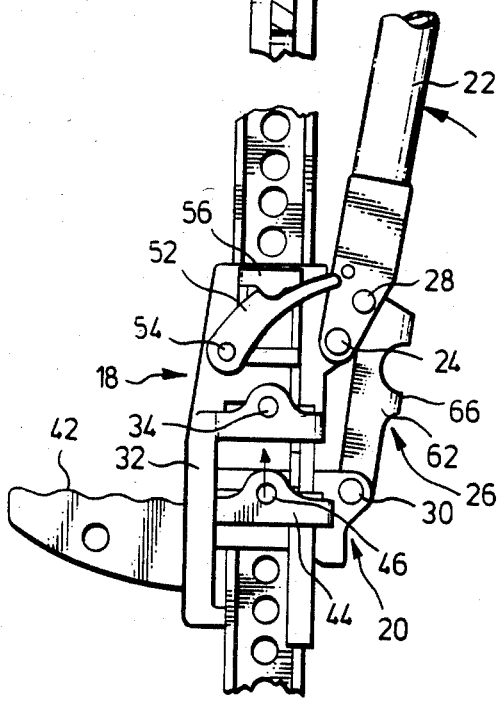
FIG. 4.

MECHANICAL LIFTING JACK

This invention relates to mechanical lifting jacks.

Mechanical lifting jacks are frequently used to raise and lower relatively large loads, for example up to about 8,000 lbs (about 3,620 kg). Such jacks usually comprise a vertical support upon which an upper lifting assembly and lower follower assembly are slidably mounted, the lifting and follower assemblies being engageable with the support at predetermined positions over its height. An operating handle has one end pivotally connected to the lifting assembly and a link is pivotally connected at an upper end to the handle and at a lower end to the follower assembly. The lifting assembly carries a reversing member which is set in one position for lifting a load and in another position for lowering a load. With the reversing member in the up position and with the lifting assembly engaging a load, the load can be raised by moving the handle downwardly and upwardly to alternately raise the lifting assembly and the follower assembly. By moving the reversing member to the down position, the load can be lowered by similar movement of the handle. Such jacks are of course well known.

A safety problem has existed for many years in that accidents may occur if an attempt is made to use such a jack to raise a load greater than the load raising capacity of the jack. It is therefore an object of the invention to provide a jack of this kind which incorporates a safety arrangement which reduces the likelihood of an accident occurring if the jack is used to attempt to raise a load above its rated capacity.

According to the invention, the link between the operating handle and the follower assembly is constructed as a safety link which yields by deformation if an attempt is made, by downward angular movement of the handle, to lift a load above a predetermined value. Thus, the safety link will gradually yield as the handle is moved angularly downwardly and no dangerous situation occurs, since for example the handle will not fly up and the load will remain stationary at whatever height the link deforms, which is in contrast to what may happen with prior art jacks. If the safety link deforms, another suitable jack or jacks can then be positioned to support the load.

The advantages of such a safety link in accordance with the invention are thus readily apparent when compared for example to the sudden breakage of a shear pin in prior art jack of this kind. Also, when a safety link in accordance with this invention is used, an operator cannot circumvent or override this safety feature. Further, the safety link is easy to install on a prior art jack of this kind or when replacing a deformed safety link.

The safety link may have a U-shaped section with substantially parallel arm portions extending from opposite sides of the base portion, the arms being pivotally connected at an upper end to the handle and at a lower end to the follower assembly, and the base portion of the U-shape having an aperture extending a predermined amount into the arm portions to thereby weaken the arm portions in the vicinity of the aperture to cause the arm portions to yield by deformation in the vicinity of the aperture when an attempt is made to raise a load above the predetermined value.

Figure 2:
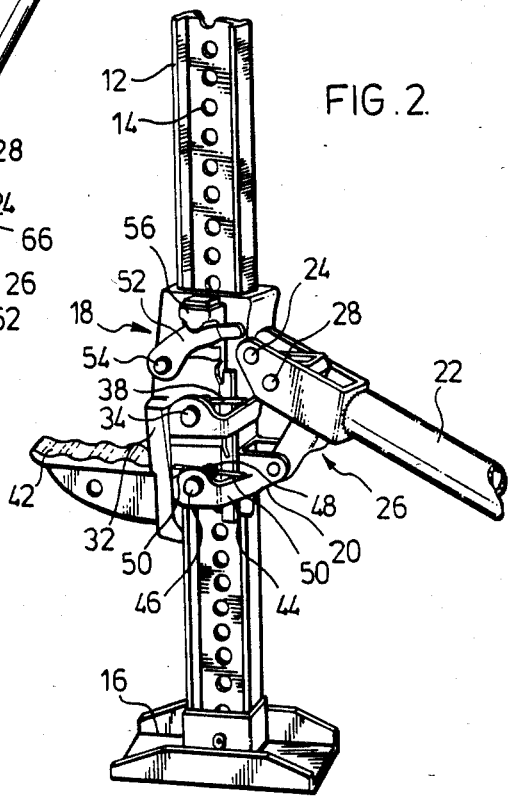
Figure 6:
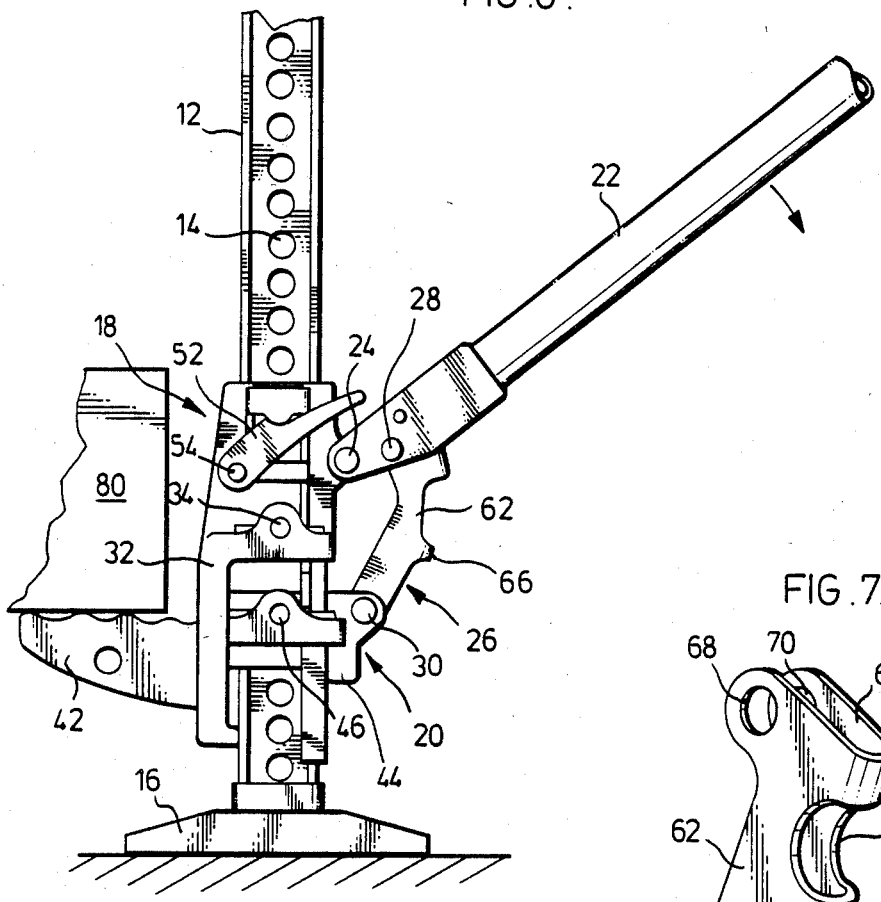
Figure 7:
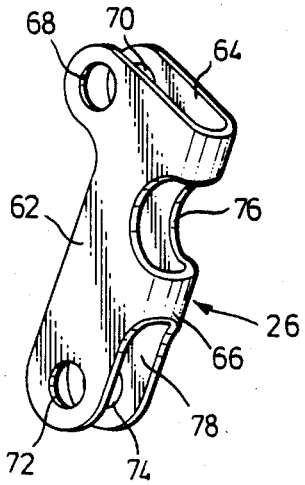
Figure 8:
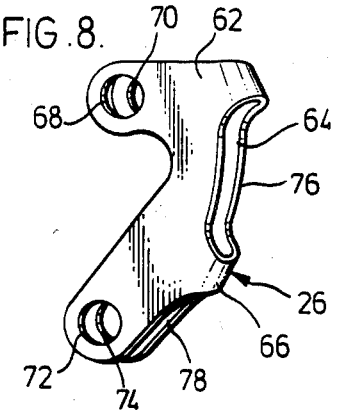

One embodiment of the invention will now be described, by way of example, with reference to the accompanying drawing, of which:

FIG. 1 is a side view of a mechanical lifting jack, showing the operating handle in an upper position, FIG. 2 is an other side view showing the operating handle in a lower position, FIG. 3 is a front view, partly in section, of parts of the upper lifting assembly and the lower follower assembly, FIG. 4 is a side view of the lifting mechanism with the operating handle in an upper position, FIG. 5 is a similar view showing the operating handle in the initial portion of downward movement, FIG. 6 is a similar view to FIG. 5 but showing deformation of the safety link when an attempt is made to lift an oversize load, FIG. 7 is a perspective view of the safety link in its normal configuration, and FIG. 8 is a view similar to FIG. 7 but showing the safety link after deformation.

Referring to the drawings, a mechanical lifting jack includes a vertical support 12 with an I-beam section having a series of regularly spaced apertures 14 extending from the bottom to the top thereof, the vertical support 12 being mounted on a base plate 16. An upper lifting assembly 18 and a lower follower assembly 20 of conventional construction are slidably mounted on the support. An operating handle 22 is pivotally connected to the lifting assembly 18 by a pin 24, and a safety link 26 in accordance with the invention is pivotally connected at its upper end to the handle 22 by a pin 28 and at its lower end to the follower assembly 20 by a pin 30.

With the exception of the safety link 26, the jack is of conventional construction, a conventional jack of this kind having a conventional link between the lifting assembly 18 and the follower assembly 20. The lifting assembly 18 and the follower assembly 20 will accordingly only be briefly described, since the nature of their construction and operation is conventional.

The upper lifting assembly 18 includes a main body 32 slidably mounted on the vertical support 12. The main body 32 carries a pin 34 which is urged by a spring 36 towards the apertures 14, the spring 36 acting between a portion of the main body 32 and a rod 38 carried by the pin 34 and projecting from opposite sides thereof across portions of the main body 32. The upper part of the end of the pin 34 engageable in the apertures 14 is bevelled at 40 for a purpose which will be described later. The main body 32 has a load-engaging foot 42 at its lower end. The follower assembly 20 has a main body 4 slidably mounted in the lower part of the lifting assembly 18, the main body 44 carrying a pin 46 which is urged by spring 48 towards the apertures 14, the spring 48 acting between a portion of the main body 44 and a rod 50 carried by the pin 46 and projecting from opposite sides thereof across portions of the main body 44. The upper part of the end of the pin 46 engageable in apertures 14 is bevelled at 47, again for a purpose to be described.

A reversing member 52 is pivotally mounted on the main body 32 of the lifting assembly 18 by means of a bolt 54, the reversing member 52 being pivotal between an up position shown in the drawings and a down position. In the up position, as shown, reversing member 52 engages a cam member 56 slidably carried by the main body 32 of the lifting assembly 18. The cam member 56 is urged downwardly by a spring (not shown) acting between the cam member 56 and the main body 32. When the reversing member 52 is in the up position as shown, it holds the cam member 56 in an upper position against the force exerted by the spring, cam member 56 being spaced from the pin rods 38, 50 in the upper position.

In normal operation of the jack with an acceptable load, see FIGS. 1 to 5 and 7, the jack is located to position the foot 42 under the load, and the handle 22 is moved downwarldy and upwardly, with the reversing member 52 of course being in the upper position. Initially, the pins 34, 36 of the lifting assembly 18 and follower assembly 20 are engaged in respect of apertures 14 of the vertical support 12, see especially FIG. 3. With downward movement of the handle 22, the lifting assembly 18 is moved upwardly, with the bevelled surface 40 of the pin 34 engaging the upper edge of the aperture 14 such that the pin 34 is forced out of the aperture 14 against the spring 36 to permit the lifting assembly 18 to rise until the pin 34 engages in the next higher aperture 14. During such movement, the load is transmitted through link 26 to the follower assembly 20. Subsequent upward movement of the handle 22 then causes the follower assembly 20 to move up by one increment in similar manner.

To lower the load, the reversing member 52 is moved clockwise to the down position to permit the cam member 56 to move downwardly under the action of its spring and engage the rods 38, 50 of pins 34, 46. However, under load, the pins 34, 46 are retained in the apertures by friction. Upward force on the handle 22 takes off the load between pin 46 of follower assembly 20 and the wall of the aperture 14, so that the cam member 56 can moved down to cause its cam surface 58 to engage the rod 50 of pin 56 and force it out of the aperture 14 so that the follower assembly 20 moves downwardly until pin 46 engages in the next lower aperture 14. Downward force on the handle 22 then effects a similar result with lifting assembly 18 due to engagement of a cam surface 60 of cam member 56 with the rod 38 of pin 34. When the lowering of the load has been completed or the load is below a predetermined amount, the spring (not shown) urging the cam member 56 downwardly is strong enough to cause the cam member 56 to force both pins 34, 36 out of their apertures 14 so that both the lifting assembly 18 and follower assembly 20 fall away from the load to the bottom of the vertical support 12.

As explained earlier, the operation of the jack as so far described is conventional, and consequently no further explanation is necessary for a person skilled in the art.

In accordance with the invention, the link 26 is the safety link which is deformed if an attempt is made to lift a load above a predetermined value. According to a preferred embodiment, as shown in FIG. 7, the link 26 is of U-shape section having spaced parallel arms 62, 64 connedted by a base portion 66. Upper end portions of the arms 62, 64 have apertures 68, 70 to receive pin 28, and lower end portions of the arms 62, 64 have apertures 72, 74 to receive pin 30. The base portion 66 is interrupted near the upper end to provide an aperture 76 which extends into the arms 62, 64, and is also interrupted over the lower part of its length to provide an opening 78.

If an attempt is made to lift a load 80 of excessive weight, see FIGS. 6 and 8, downward force on handle 42 to attempt to raise the lifting assembly 22 causes the link 26 to yield by deformation in the vicinity of the aperture 26, as shown in FIGS. 6 and 8, so that the lifting assembly 18 is not moved. It is not then possible to raise or lower the load. The load cannot be lowered even if the reversing member 52 is moved to the down position since the handle 22 cannot be operated to remove the frictional engagement between pin 34 and the wall of the aperture 14. It is therefore necessary to utilize further jacks of satisfactory load capacity to raise or lower the overweight load 80.

Other embodiments will be readily apparent to a person skilled in the art, the scope of the invention being defined in the appended claims.

What I claim as new and desire to protect by Letters Patent of the United States is:

1. A mechanical lifting jack comprising a vertical support, an upper lifting assembly and a lower follower assembly slidably mounted on the vertical support and engageable therewith at predetermined positions over the height thereof, an operating handle pivotally connected at one end to the lifting assembly for upward and downward angular movement, and a safety link pivotally connected at an upper end to the handle and at a lower end to the follower assembly, the lifting assembly carrying a reversing member operable in one position to cause a load engaged by the lifting assembly to be raised by alternate upward movement of the lifting assembly and follower assembly up the support when the handle is moved upwardly and downwardly, and operable in another position to cause a load to be lowered by alternate downward movement of the lifting assembly and follower assembly with similar movement of the handle, and the safety link having a U-shaped section with substantially parallel arm portions extending from opposite sides of the raised portion, the arms being pivotally connected at an upper end to the handle and at a lower end to the follower assembly, and the base portion of the U-shape having an aperture extending a predetermined amount into the arm portions to thereby weaken the arm portions in the vicinity of the aperture to cause the arm portions to yield by deformation in the vicinity of the aperture when an attempt is made to raise a load above the predetermined value and prevent further raising or lowering of the load.

* * * * *